US005503500A

United States Patent [19]

Oliver et al.

[11] Patent Number: 5,503,500

[45] Date of Patent: Apr. 2, 1996

[54] PIER SUPPORT

[76] Inventors: James Oliver; Evon L. Oliver, both of 1990-D McCulloch Blvd., #110, Lake Havasu City, Ariz. 86403

[21] Appl. No.: 212,911

[22] Filed: Mar. 15, 1994

[51] Int. Cl.[6] ..... E02D 27/00

[52] U.S. Cl. ..... 405/229; 52/167.1; 248/678; 405/230

[58] Field of Search ..... 405/229, 230; 248/357, 678; 52/167.1–167.6, 126.6; 108/DIG. 901, DIG. 902

[56] References Cited

U.S. PATENT DOCUMENTS

| | | | |
|---|---|---|---|
| 776,419 | 11/1904 | Platt | 405/229 X |
| 1,656,382 | 1/1928 | McColley | 248/357 X |
| 2,367,146 | 1/1945 | Siebs | 405/229 X |
| 3,347,002 | 10/1967 | Penkuhn | 405/229 X |
| 3,710,733 | 1/1973 | Story | 108/901 X |
| 4,189,125 | 2/1980 | Little | 108/901 X |
| 4,316,419 | 2/1982 | Cupido | 108/901 X |
| 4,869,456 | 9/1989 | Jacobs | 248/678 |
| 4,886,399 | 12/1989 | Pidgeon | 405/229 |
| 5,083,404 | 1/1992 | Schulte | 52/167.1 |

*Primary Examiner*—Dennis L. Taylor
*Attorney, Agent, or Firm*—Calif Kip Tervo

[57] ABSTRACT

A support, for a pier of the type having a base with a bottom surface area and fastener-receiving bores therethrough, generally comprises a panel with plurality of ribs attached thereto as a stiffening grid; the free sides of the ribs defining a support plane that is parallel to the panel. A plurality of attachment bores in the support receive fasteners for attaching the pier base to the support such that shear forces between the pier and the support are resisted. Shear pegs in shear bores resist shear forces between stacked supports. A plurality of anchor bores through the support each may receive a anchor rod for resisting shear forces between said support and the ground. In an exemplary stacked configuration, the top support has its first side upward, preferably attached to the pier and the bottom support has its first side downward. An alternate stacked embodiment comprises a base of two lower supports laid end to end with an overlapping support overlapping their juncture and supporting the pier directly or supporting another support.

16 Claims, 2 Drawing Sheets

PIER SUPPORT

BACKGROUND OF THE INVENTION

1. Field of the Invention

This invention relates in general to supports for piers or jacks for mobile home coaches and more particularly involves stackable supports with shear connectors.

2. Description of the Related Art

Mobile home coaches are supported by a plurality of piers. The piers are placed periodically under the coach frame. The height of each pier is adjustable over some range. If the desired frame height is higher than the pier height, then supports must be placed under the pier. Also, since the pier is supported often simply by the ground, a pier support of larger area than the base of the pier spreads out the load and prevents sinking into the ground.

Conventional wooden boards used for pier supports have several disadvantages. Wooden boards deteriorate, such as by rotting or by being attacked by termites. Consequently, it is often difficult to determine the condition and strength of a wooden support. Therefore, it is desirable to have a pier support, the strength of which is easily known.

One of the major problems in supporting mobile coaches is the tendency to slide off the supports, particularly if they are stacked, during an earthquake because of shear forces. Therefore, it is desirable to have a pier support that resists shear forces of the type caused by an earthquake.

SUMMARY OF THE INVENTION

This invention is a support for a pier of the type having a base with a bottom surface area and with fastener-receiving bores therethrough. The support generally comprises a panel having an outside wall, that is a planar surface defining a first side of the support, and an inside wall and a plurality of ribs attached to the panel as a stiffening grid. Each rib has an attached side attached to the inside wall of the panel and a free side; the free sides of the ribs defining a support plane that is parallel to said outside wall of the panel and that defines a second side of the support.

A plurality of attachment bores in the support receive fasteners for attaching the pier base to the support such that shear forces between the pier and the support are resisted.

A plurality of first shear bores in the first side of the support and a plurality of second shear bores in said second side of said support are positioned so as to align with shear bores on an immediately adjacent stacked support such that a plurality of shear pegs may be placed in the bores to resist shear between stacked supports. Preferably, the first and second shear bores are co-axial blind bores.

A plurality of anchor bores through the support each may receive an anchor rod for resisting shear forces between said support and the ground.

In an exemplary stacked configuration, the top support has its first side upward, preferably attached to the pier and the bottom support has its first side downward.

An alternate stacked embodiment comprises a base of two lower supports laid end to end with an overlapping support overlapping their juncture and supporting the pier directly or supporting another support.

Other features and many attendant advantages of the invention will become more apparent upon a reading of the following detailed description together with the drawings in which like reference numerals refer to like parts throughout.

DETAILED DESCRIPTION OF THE INVENTION

Figure 3:
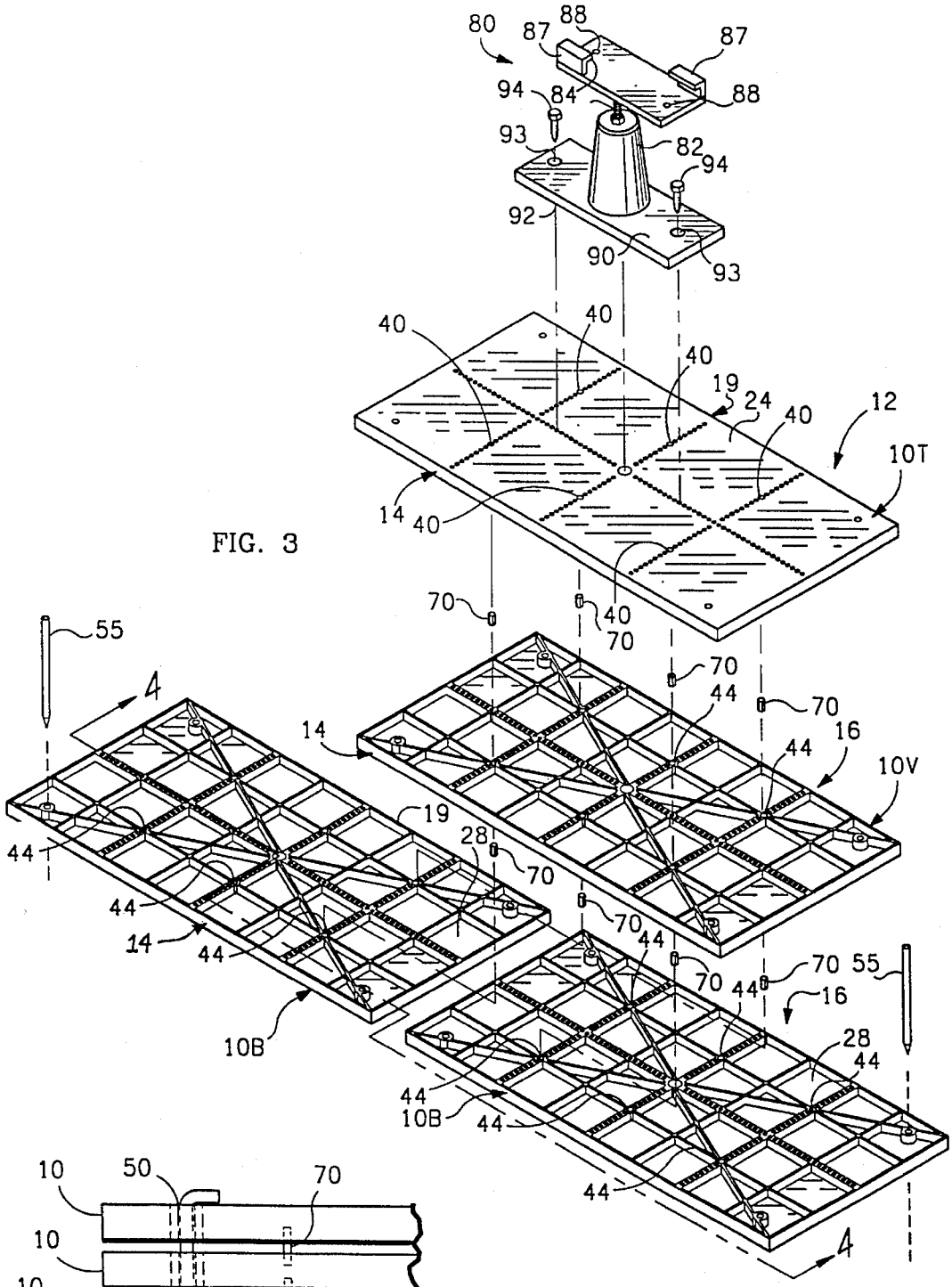
FIG. 3 is an exploded reduced perspective view of four pier supports of FIG. 1 in an exemplary stacked configuration supporting a pier.

With reference to the drawings and more particularly to FIG. 3 thereof, there is shown an exploded perspective view of a stack of four pier supports, each denoted generally as 10, of the invention in an exemplary stacked configuration supporting a pier, denoted generally as 80. Pier 80 includes a vertical portion 82 including a height adjustment mechanism 84 and a plate 86 for supporting a coach frame. Plate 86 may include brackets 87, bores 88 or other means for fastening or attaching plate 86 to a coach frame. The bottom 92 of base 90 of pier 80 typically provides a stable platform for vertical portion 82 and a larger surface area to spread out the pier load. Base 90 includes fastening means, such as bores 93, for receiving fasteners, such as lag bolts 94, for fastening pier 80 to a support 10.

Figure 2:
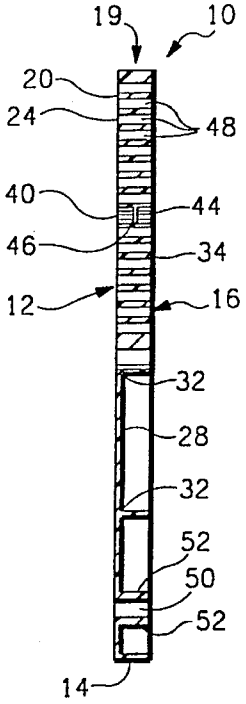
FIG. 2 is a sectional view taken on line 2—2 of FIG. 1.
Figure 1:
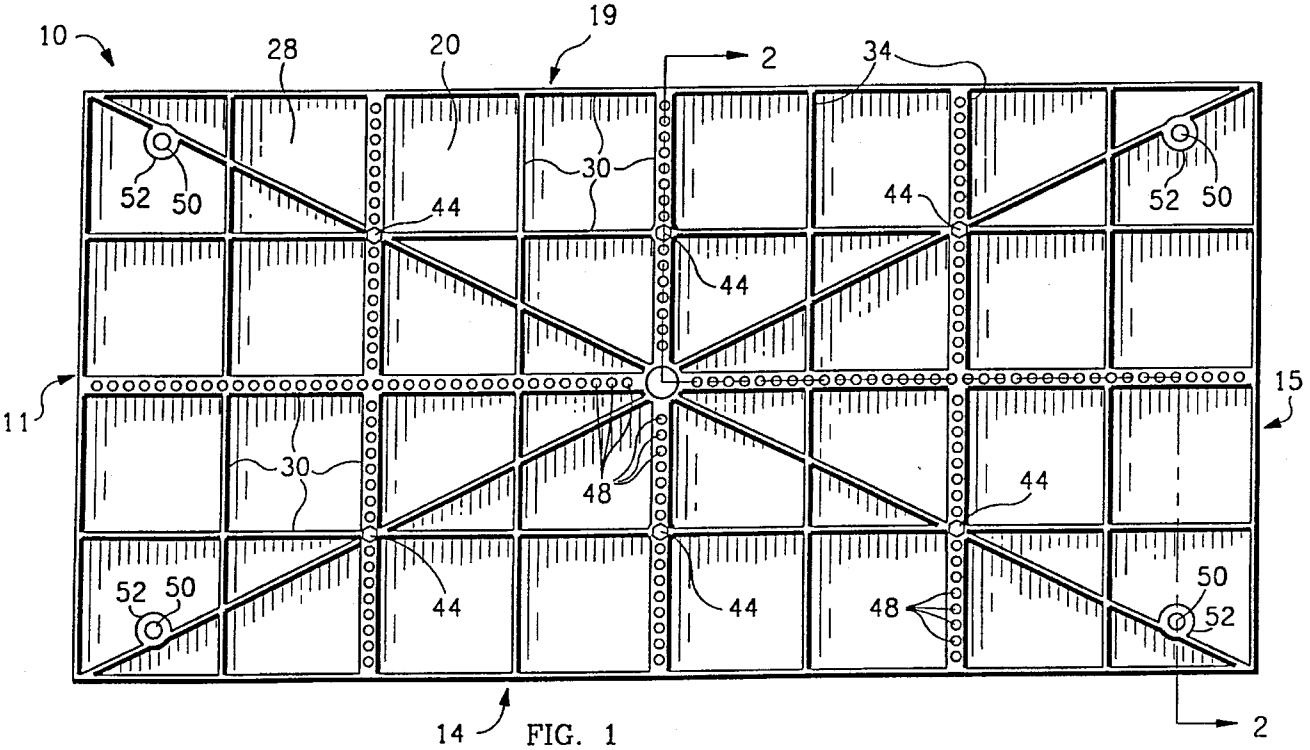
FIG. 1 is a top plan view of a preferred embodiment of the pier support of the invention.

Turning now to FIGS. 1 and 2, there is shown in FIG. 1 a top plan view of a preferred embodiment of the pier support, denoted generally as 10, of the invention and, in FIG. 2, a sectional view taken on line 2—2 of FIG. 1. Support 10, shown, is rectangular, having first end 11, second end 15, front side 14 and rear side 19, but it will be seen that other shapes are possible which utilize the teachings of the invention. Support 10 generally comprises a sheet or panel 20. Panel 20 has an outside wall 24 having a planar surface of area greater than that of the surface area of the bottom 92 of base 90 of pier 80. Preferably, the area is one and one-half feet square or greater. Outside wall 24 defines the first side 12 of support 10. Panel 20 has an inside wall 28.

A plurality of ribs 30 are attached to panel inside wall 28 and are arranged in a grid for stiffening panel 20. Each rib 30 includes an attached side 32 attached to inside wall 28 and a free side 34. The free sides 34 of ribs 30 define a support plane that is parallel to outside wall 24 and that defines the second side 16 of support 10.

Figure 4:
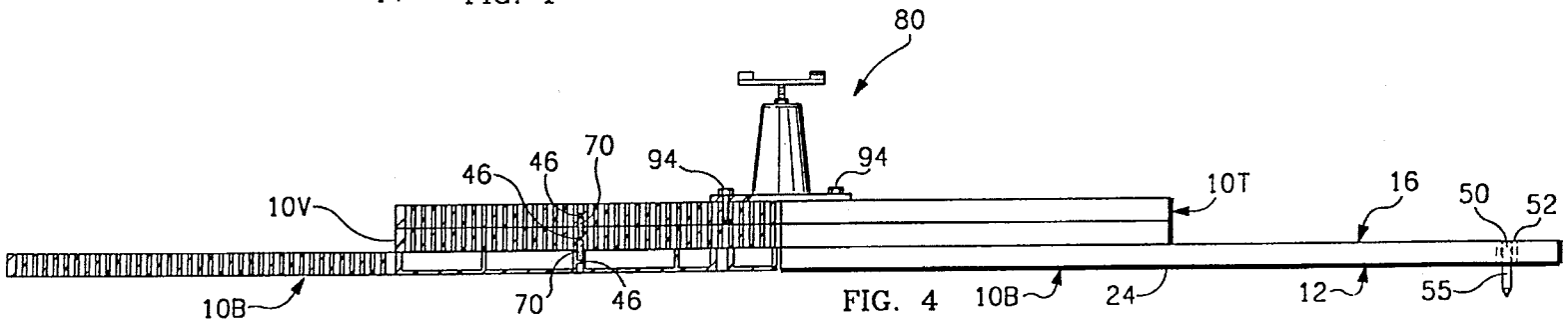
FIG. 4 is a sectional view of the stacked supports of FIG. 3 taken on line 4—4 and including the pier thereupon.

A plurality of first shear bores 40 (see FIGS. 2 and 3) enter first side 12 perpendicular to the planar surface. A plurality of second shear bores 44 enter second side 16 perpendicular to the support plane. Preferably, first shear bores 40 and second shear bores 44 are co-axial bores that are either blind or otherwise have some means, such as a restriction 46 in the middle, for preventing a shear peg (FIGS. 3 and 4) from passing completely through the bore 40,44. Ribs 30 can be of various widths. In the preferred embodiment, shown, shear bores 40,44 are in ribs 30.

Support 10 includes a plurality of attachment bores 48 for attaching a pier base 90 to support 10. In the preferred embodiment, shown, attachment bores 48 are through-bores in ribs 30 such that pier 80 may be attached to either side 12,16 of support 10.

A plurality of anchor bores 50 pass through support 10 perpendicular to sides 12,16. Anchor bores 50 are large bores for accommodating an anchor rod 55 (see FIGS. 3 and 4) and include a surrounding collar 52.

Specifically in FIG. 2, the thickness of panel 20 is seen. Co-axial blind shear bores 40,44, attachment bores 48, and anchor bore 50 and collar 52 are also shown.

Preferably, support 10 is made of non-rusting, non-rotting material, such as plastic, such as ABS. A support 10, similar to that shown, of ABS with the thickness of panel 20 being 0.120 inches and a total thickness of 0.750 inches has been tested to hold 15,000 pounds.

Returning to FIGS. 3 and 4, FIG. 3 is an exploded reduced perspective view of four pier supports 10 of FIG. 1 in an exemplary overlapping-stacked configuration supporting pier 80, and FIG. 4 is a sectional view of the stacked supports 10 of FIG. 3 taken on line 4—4 and including pier 80 attached thereupon.

In the over-lapping stacked configuration, a base is constructed of two base supports 10B placed end to end. If the surface is soft upon which base supports 10B are placed, then the panel side 12 of supports 10B is preferably placed on the ground as shown as a larger surface area to prevent sinking under load. Overlapping support 10V lies on both base supports 10*b* and overlaps their juncture. As shown, a top support 10T is stacked on overlapping support 10V. Preferably, a top support has its panel side 12 on the top so that water will not collect and rust the pier. If overlapping support 10V is the top support, preferably, panel side 12 is on top.

Shear connectors, such as a plurality of shear pegs 70, are disposed in aligning shear bores 40,44 between supports 10. Shear pegs 70 fit snugly in shear bores 40,44 and have a length such that they span between supports 10. In this manner, shear pegs 70 transfer shear forces between supports and a stacked support cannot slip off the other.

First and second shear bores 40,44 are positioned symmetrically so as to align with a plurality of first shear bores 40 on an immediately adjacent first side 12 of a said stacked support 10 or with a plurality of second shear bores 44 on an immediately adjacent second side 16 of a stacked support. In this manner, shear bores 40,44 on adjacent sides of stacked support align regardless of which side is up. If supports 10 are stacked more than two high, then shear pegs 70 and the intermediate supports 10 function as shear connectors.

Anchor rods 55 are large-diameter, long rods driven into the ground through anchor holes 50 such that the top of rod 55 remains within support 10 for opposing shear between support 10 and the ground.

Figure 5:
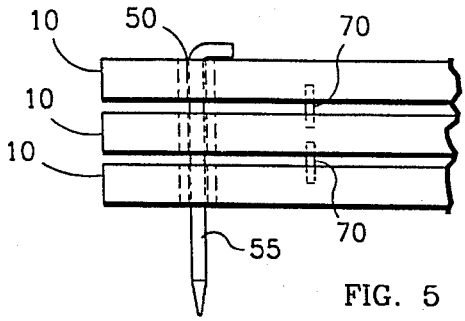
FIG. 5 is a side elevation view, partially cut away, of an alternate stack of supports and an anchor rod.

FIG. 5 is a side elevation view, partially cut away, of an alternate stack of supports 10 in which supports 10 are stacked directly on top of one another. In this configuration, anchor holes 50 align such that anchor rod 55 can be driven through all stacked supports 10 to provide shear resistance between all supports 10 and the ground.

Having described the invention, it can be seen that it provides a very convenient device for supporting a pier at various heights, for spreading out pier loading over a larger ground area and for effectively resisting shear forces.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A support for a pier of the type having a base with a bottom surface area and with fastener-receiving bores therethrough; said support comprising:

a panel having:

an outside wall that is a planar surface having a surface area greater than that of the bottom surface area of the base of a pier and defining a first side of said support; and an inside wall;

a plurality of ribs; each said rib having:

an attached side attached to said inside wall of said panel; and a free side; said ribs arranged in a grid stiffening said panel; the free sides of said ribs defining a support plane that is parallel to said outside wall of said panel and that defines a second side of said support;

a plurality of attachment bores; said bores disposed through said outside wall and into said ribs for receiving fasteners for attaching the pier base to said first side of said support such that shear forces between the pier and said support are resisted.

2. The support of claim 1 wherein:

said support further includes:

a plurality of first shear bores in said first side of said support perpendicular to said planar surface; and a plurality of second shear bores in said second side of said support perpendicular to said support plane; said first and second shear bores positioned so as to align with a plurality of said first shear bores on an immediately adjacent said first side of a stacked support or with a plurality of said second shear bores on an immediately adjacent said second side of a stacked support; such that said first shear bores and said second shear bores may receive shear pegs for connecting aligned shear bores of stacked supports for resisting shear forces between stacked supports.

3. The support of claim 2 wherein:

said first and second shear bores are co-axial blind bores.

4. The support of claim 1 further including:

a plurality of anchor bores for receiving a anchor rod for resisting shear forces between said support and the ground.

5. In combination:

a pier having a base having a bottom surface area;

a plurality of stacked supports for supporting said base of said pier and for spreading pier loading over a larger surface area including:

a bottom support; and a top support stacked on said bottom support and supporting said base of said pier; each support comprising:

a panel having:

an outside wall that is a planar surface having a surface area greater than that of said bottom surface area of said base of said pier and defining a first side of said support; and an inside wall;

a plurality of ribs; each said rib having:

an attached side attached to said inside wall of said panel; and a free side; said ribs arranged in a grid stiffening said panel; the free sides of said ribs defining a support plane that is parallel to said outside wall of said panel and that defines a second side of said support;

a plurality of first shear bores in said first side of said support perpendicular to said planar surface; and a plurality of second shear bores in said second side of said support perpendicular to said support plane; said first and second shear bores positioned so as to align with a plurality of said first shear bores on an immediately adjacent said first side of a said stacked support or with a plurality of said second shear bores on an immediately adjacent said second side of a said stacked support; and a plurality of shear pegs connecting said adjacent aligned shear bores of said stacked supports.

6. The combination of claim 5 wherein:

said bottom support has its said first side downward; and said top support has its said first side upward.

7. The combination of claim 5 wherein:

said top support includes, on its said first side, attachment bores;

said top support has its said first side upward; and further including:

fasteners attaching said pier base to said attachment bores such that shear forces between said pier and said support are resisted.

8. The combination of claim 5 wherein:

said first and second shear bores are co-axial blind bores.

9. In combination:

a pier having a base having a bottom surface area;

a plurality of stacked rectangular supports for supporting said base of said pier; said stacked supports including;

two lower supports laid end to end; and an overlapping support stacked on said two lower supports and overlapping their juncture and supporting said base of said pier; each support comprising:

first and second ends;

a rectangular panel having:

an outside wall that is a planar surface having a surface area greater than that of said bottom surface area of said base of said pier and defining a first side of said support; and an inside wall;

a plurality of ribs; each said rib having:

an attached side attached to said inside wall of said panel; and a free side; said ribs arranged in a grid stiffening said panel; the free sides of said ribs defining a support plane that is parallel to said outside wall of said panel and that defines a second side of said support;

a plurality of first shear bores in said first side of said support perpendicular to said planar surface; and a plurality of second shear bores in said second side of said support perpendicular to said support plane; said first and second shear bores positioned so as to align with a plurality of said first shear bores on an immediately adjacent said first side of a said stacked support or with a plurality of said second shear bores on an immediately adjacent said second side of a said stacked support; and a plurality of shear pegs connecting said adjacent aligned shear bores of said stacked supports.

10. The combination of claim 9 wherein:

said lower supports have their said first sides downward; and said overlapping support has its said first side upward.

11. The combination of claim 9 wherein:

said overlapping support includes, on its said first side, attachment bores;

said overlapping support has its said first side upward; and further including:

fasteners attaching said pier base to said attachment bores such that shear forces between said pier and said support are resisted.

12. The combination of claim 9 wherein:

said first and second shear bores are co-axial blind bores.

13. In combination:

a pier having a base having a bottom surface area;

a plurality of stacked rectangular supports for supporting said base of said pier; said stacked supports including;

a base of two lower supports laid end to end;

a tower of two or more stacked supports including:

an overlapping support stacked on said two lower supports and overlapping their juncture; and a top support supporting said base of said pier; each support comprising:

first and second ends;

a rectangular panel having:

an outside wall that is a planar surface having a surface area greater than that of said bottom surface area of said base of said pier and defining a first side of said support; and an inside wall;

a plurality of ribs; each said rib having:

an attached side attached to said inside wall of said panel; and a free side; said ribs arranged in a grid stiffening said panel; the free sides of said ribs defining a support plane that is parallel to said outside wall of said panel and that defines a second side of said support;

a plurality of first shear bores in said first side of said support perpendicular to said planar surface; and a plurality of second shear bores in said second side of said support perpendicular to said support plane; said first and second shear bores positioned so as to align with a plurality of said first shear bores on an immediately adjacent said first side of a said stacked support or with a plurality of said second shear bores on an immediately adjacent said second side of a said stacked support; and shear connector means for resisting shear forces between said supports including:

a plurality of shear pegs in aligned shear bores of said stacked supports.

14. The combination of claim 13 wherein:

said lower supports have their first sides downward; and said overlapping support has its said first side downward and said top support has its said first side upward.

15. The combination of claim 13 wherein:

said top support includes, on its said first side, attachment bores;

said top support has its said first side upward; and further including:

fasteners attaching said pier base to said attachment bores such that shear forces between said pier and said support are resisted.

16. The combination of claim 13 wherein:

said first and second shear bores are co-axial blind bores.

* * * * *